US009091070B2

(12) United States Patent
Walker

(10) Patent No.: US 9,091,070 B2
(45) Date of Patent: Jul. 28, 2015

(54) GUTTER GUARD

(75) Inventor: Simon Walker, Delta (CA)

(73) Assignee: PEAK INNOVATIONS INC., Richmond, British Columbia (CA)

( * ) Notice: Subject to any disclaimer, the term of this patent is extended or adjusted under 35 U.S.C. 154(b) by 265 days.

(21) Appl. No.: 13/335,605

(22) Filed: Dec. 22, 2011

(65) Prior Publication Data

US 2012/0186163 A1 Jul. 26, 2012

(30) Foreign Application Priority Data

Jan. 26, 2011 (CA) ..... 2729384

(51) Int. Cl.
*E04D 13/076* (2006.01)

(52) U.S. Cl.
CPC ..... *E04D 13/076* (2013.01)

(58) Field of Classification Search
CPC . E04D 13/076; E04D 13/064; E04D 13/0725; E04D 13/0645; E04D 13/0727; E04D 13/0767
USPC ..... 52/11–16; 248/48.1
See application file for complete search history.

(56) References Cited

U.S. PATENT DOCUMENTS

| | | | | |
|---|---|---|---|---|
| 3,741,398 | A * | 6/1973 | Abramson | 210/474 |
| 5,271,192 | A | 12/1993 | Nothum, Sr. et al. | |
| 5,660,001 | A * | 8/1997 | Albracht | 52/12 |
| 6,598,352 | B2 * | 7/2003 | Higginbotham | 52/12 |
| 6,944,992 | B2 | 9/2005 | Brochu | |
| D523,538 | S | 6/2006 | Brochu | |
| 7,143,549 | B2 | 12/2006 | Brochu | |
| 7,793,465 | B2 | 9/2010 | McCann | |
| 7,891,142 | B1 * | 2/2011 | Ealer, Sr. | 52/12 |
| 7,908,797 | B2 | 3/2011 | Graves | |
| D638,920 | S | 5/2011 | Ealer, Sr. | |
| 8,001,729 | B2 * | 8/2011 | Joly et al. | 52/12 |
| 8,276,321 | B2 * | 10/2012 | Bell | 52/12 |

(Continued)

FOREIGN PATENT DOCUMENTS

| | | | |
|---|---|---|---|
| CA | 2364602 | C | 7/2005 |
| CA | 2521542 | C | 1/2007 |

(Continued)

OTHER PUBLICATIONS

Leaf Relief-Gutter Protection That Really Works, Presentation, Ply Gem, Kansas City, MO.

*Primary Examiner* — Brian Glessner
*Assistant Examiner* — Adam Barlow
(74) *Attorney, Agent, or Firm* — Timothy E. Siegel Patent Law, PLLC; Timothy E. Siegel

(57) ABSTRACT

A rain gutter guard comprises a downward leg for abutting gutter hangers when the guard is urged down into the gutter. A shoulder of the guard accommodates the shoulder of the gutter hangers. A front attachment flap secures the front of the guard to the gutter while the rear is retained by friction fit of an angled segment against the building fascia. An upstanding wall separates the central portion from the attachment flap. The central portion is inclined rearward and the attachment flap inclines to the front.

15 Claims, 5 Drawing Sheets

(56) References Cited

U.S. PATENT DOCUMENTS

| | | | | |
|---|---|---|---|---|
| 2005/0166465 | A1* | 8/2005 | Banks et al. | 52/11 |
| 2006/0179723 | A1 | 8/2006 | Robins | |
| 2006/0201068 | A1 | 9/2006 | Shane | |
| 2008/0010906 | A1* | 1/2008 | Brochu | 52/12 |
| 2008/0098661 | A1* | 5/2008 | McCann | 52/12 |
| 2011/0099917 | A1 | 5/2011 | Gramling | |
| 2011/0185641 | A1* | 8/2011 | Snell | 52/12 |

FOREIGN PATENT DOCUMENTS

| | | | |
|---|---|---|---|
| CA | 108795 | | 9/2007 |
| CA | 2577571 | A1 | 8/2008 |
| CA | 2608530 | A1 | 4/2009 |
| CA | 132338 | | 5/2010 |

* cited by examiner

GUTTER GUARD

FIELD OF THE INVENTION

This invention relates to gutter guards used to prevent debris from clogging a rain gutter.

BACKGROUND OF THE INVENTION

Gutter guards include a perforated planar surface that spans the rain gutter opening to allow water to drain into the gutter while preventing debris from doing so. The front of the guard is usually secured or retained on the front lip of the gutter, for example by means of fasteners, a clip system or by shaping the front edge of the guard such that it is physically engaged on or under the lip.

In some cases, such as disclosed in U.S. Pat. No. 7,614,185 to Brochu, the guard is designed to seat in a recessed position in the gutter. Such an arrangement creates a lip or wall at the front of the guard to stop fast moving water from simply flowing across the guard and to the ground, which risks defeating the purpose of the gutter. Despite the front lip or wall formed by a recessed gutter guard, large quantities of fast-flowing water from the roof can overwhelm the apertures in the forward portion of the guard where accumulating water can spill over the front lip of the recessed gutter guard before it can drain through the apertures.

Older-style prior art rain gutters are typically secured to the fascia of the building by a spike and ferrule system in which a nail or spike is inserted into a ferrule extending from the front of the gutter and through the rear wall of the gutter, so as to embed in the fascia. Spike and ferrule systems usually involve unthreaded nails or spikes that may not provide a secure fastening to the fascia and are sometimes difficult to install, particularly for do-it-yourselfers. More recently, the use of gutter hangers has become the preferred means of installing gutters. Gutter hangers extend between the front and rear walls of the gutter and a wall screw is inserted through the hanger, through its rear wall and into the fascia. Gutter hangers are provided at spaced locations along the length of the gutter as illustrated in FIG. 1. The present applicant supplies gutter hangers with a pre-installed threaded fastener to facilitate installation.

However, gutter hangers present a potential obstacle to installation of recessed gutter guards. Guards are typically manufactured in predetermined lengths of roll-formed product having a uniform profile along their lengths. As some gutter hangers have shoulders near the top rear of the gutter, the presence of the shoulders inhibits the ability to install a guard any deeper into the gutter than the height of the gutter hangers. For example, Canadian Patent No. 2,597,976 to Brochu discloses a guard that includes a planar top portion and a rear wall that extends along the rear of the gutter to support the guard on the bottom of the gutter. The presence of the rear wall renders the disclosed system unusable with gutter hangers that have a shoulder as the rear wall of the guard would be impeded by the hangers.

The rear of the guard may be secured by fasteners or it may passively abut either the rear of the gutter, the fascia or in some cases be wedged under the shingles of the roof. The use of fasteners at the rear of the guard increases the chance of water seepage into the underlying fascia of the building. US Patent Publication No. US 2009/0031638 to Iannelli avoids the use of fasteners at the rear of the guard by wedging the guard between the roof structure and the roof shingles. That approach is obviously labour intensive, requires skill, risks snapping the shingles if they are brittle and may be difficult to achieve after construction of the roof has been completed. It is also limited by the proximity of the roof line to the gutter, which may vary from building to building and allows rainwater to shoot off the front of the gutters.

US Patent Publication No. US 2009/0108144 to Brochu discloses a passive abutment of an angled rear portion of the guard against the fascia or a hook that engages the rear wall of the gutter. Such passive support systems have the advantage of being easy to install and of not requiring additional fasteners or specialized tools. However such systems run the risk of improper installation if the rear of the guard is pushed down hard enough to seat the rear of the guard below its most effective height. The same result can follow from the weight of snow or ice. This can result in bending of the guard along its length or if installed too low, obstruction of the flow of water along the gutter.

It is an object of the present invention to provide a partially recessed roll-formable gutter guard that is easy to install in conjunction with gutter hangers. Another object of the invention is to avoid the use of fasteners at the rear of the guard. It is a further object of the invention to minimize the accumulation of water at the front of the gutter guard.

These and other objects of the invention will be better understood by reference to the detailed description of the preferred embodiment which follows. Note that not all of the objects are necessarily met by all embodiments of the invention described below or by the invention defined by each of the claims.

SUMMARY OF THE INVENTION

According to one aspect of the invention, a gutter guard comprises a downwardly extending support leg that is designed to rest on all styles of gutter hangers and to provide longitudinal rigidity to the guard. In a related aspect, the leg is omitted for a short distance adjacent a side edge of the guard or the side edge is provided with a notch to accommodate the support leg, thereby permitting lengths of gutter guard to be joined in partially overlapping relationship in the gutter.

The support leg also serves to provide longitudinal rigidity to the guard which facilitates handling and facilitates the use of a friction fit of the rear of the guard with the fascia.

According to an aspect of the invention, the friction fit is facilitated by an upwardly angled rear end of the guard, the upward angle also contributing to directing water away from the fascia.

In another aspect of the invention, the guard includes a rear shoulder portion to accommodate the shoulder of the gutter hangers in the event that the gutter hangers have a rear shoulder, while still allowing the principal planar surface of the guard to be recessed or partially recessed within the gutter. In a more particular aspect, the invention comprises the arrangement of the walls forming the shoulder.

In another aspect, a flat attachment face is provided at the front of the guard for overlying and securing it to the front lip of the gutter.

In a further aspect, the central planar portion of the guard has a slight rearward sloping angle to flow water away from the front lip of the guard to avoid the accumulation of water near the front lip and an upstanding wall is provided between the central portion and the attachment flap to discourage water from flushing over the front lip of the gutter.

The attachment flap is angled slightly downward from back to front to direct water off the attachment face and to maintain a more closely flush line when viewed from the front of the building. A forward downward angle to the top wall of the rear shoulder assists in isolating the connection between the fascia and the hanger wall screw from water.

In yet another aspect, the invention comprises a rain gutter guard adapted for use in a recessed position within a gutter that is mounted to a building wall by a series of spaced gutter hangers. The gutter guard comprises a porous surface for substantially spanning the width of the gutter and includes a leg extending downward from the surface and is adapted to rest on the gutter hangers when the gutter guard is urged downward within the gutter.

In another aspect, the invention is an assembly of a rain gutter and a gutter guard comprising a series of spaced gutter hangers for mounting a gutter to a vertical building surface. The gutter guard has a porous surface that substantially spans the width of the gutter and a leg extending downward from the surface and adapted to rest on the gutter hangers when the gutter guard is urged downward within the gutter. The support leg extends downward a distance substantially less than the depth of said gutter.

In a method aspect, the invention comprises a method of installing a gutter guard on a rain gutter that is secured to a vertical building surface by a series of spaced gutter hangers. A gutter guard as described above is installed such that the leg rests on the gutter hangers and a rear edge of the gutter guard is substantially proximal to a rear edge of said gutter.

Other aspects of the invention relate to the presence of an upwardly angled segment at the rearmost end of the guard for resilient abutment against the building wall, the particular inclination of the central portion, an angle provided to the attachment flap, an angle provided to a second wall forming a part of the shoulder, and an angle provided for a rearmost segment of the guard.

The foregoing was intended as a broad summary only and of only some of the aspects of the invention. It was not intended to define the limits or requirements of the invention. Other aspects of the invention will be appreciated by reference to the detailed description of the exemplary preferred embodiment and to the claims by which the invention is defined.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

The following describes a preferred implementation of the inventive concepts of the invention. There may of course be various other manners of embodying the same inventive concepts and this section of the specification therefore does not purport to describe the full extent or scope of the invention but merely to illustrate the preferred embodiment thereof.

Figure 1:
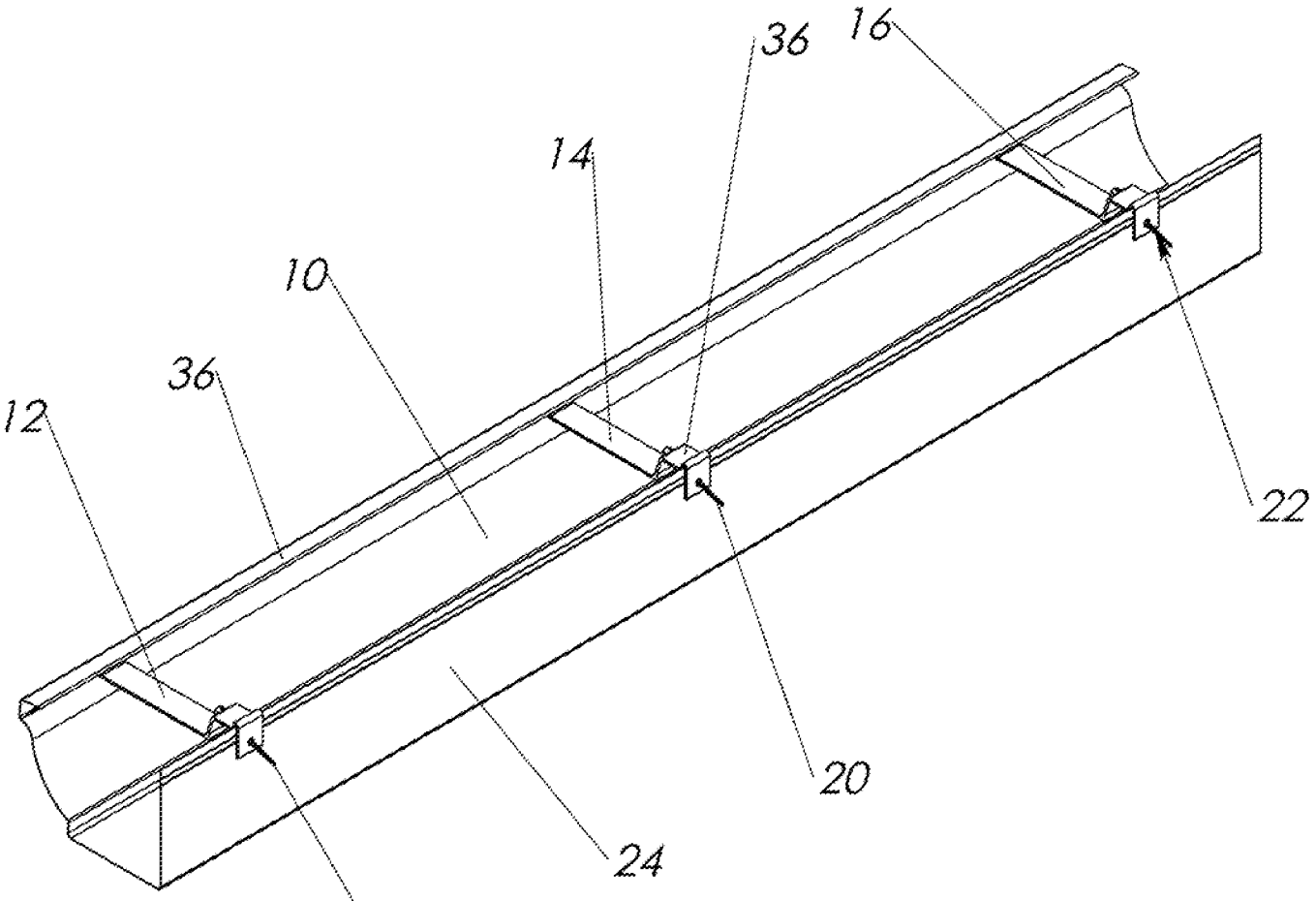
FIG. 1 is a perspective front view of a typical gutter showing a plurality of gutter hangers according to the prior art.

FIG. 1 is a perspective view of a prior art gutter 10 with gutter hangers 12, 14, 16 being provided at spaced locations to secure the gutter to the fascia of a building. The preferred embodiment of gutter hangers are available with pre-installed wall screws 18, 20, 22 that are screwed through the rear wall 24 of the gutter and into the fascia of the building (the fascia is not shown in the drawings). A fastening shoulder 36 is provided in the gutter hanger to retain and align the wall screws to the rear of the gutter 10. While not all gutter hangers have such a shoulder, one feature of the preferred embodiment of the invention is best appreciated by reference to gutter hangers having shoulders as shown.

Figure 2:
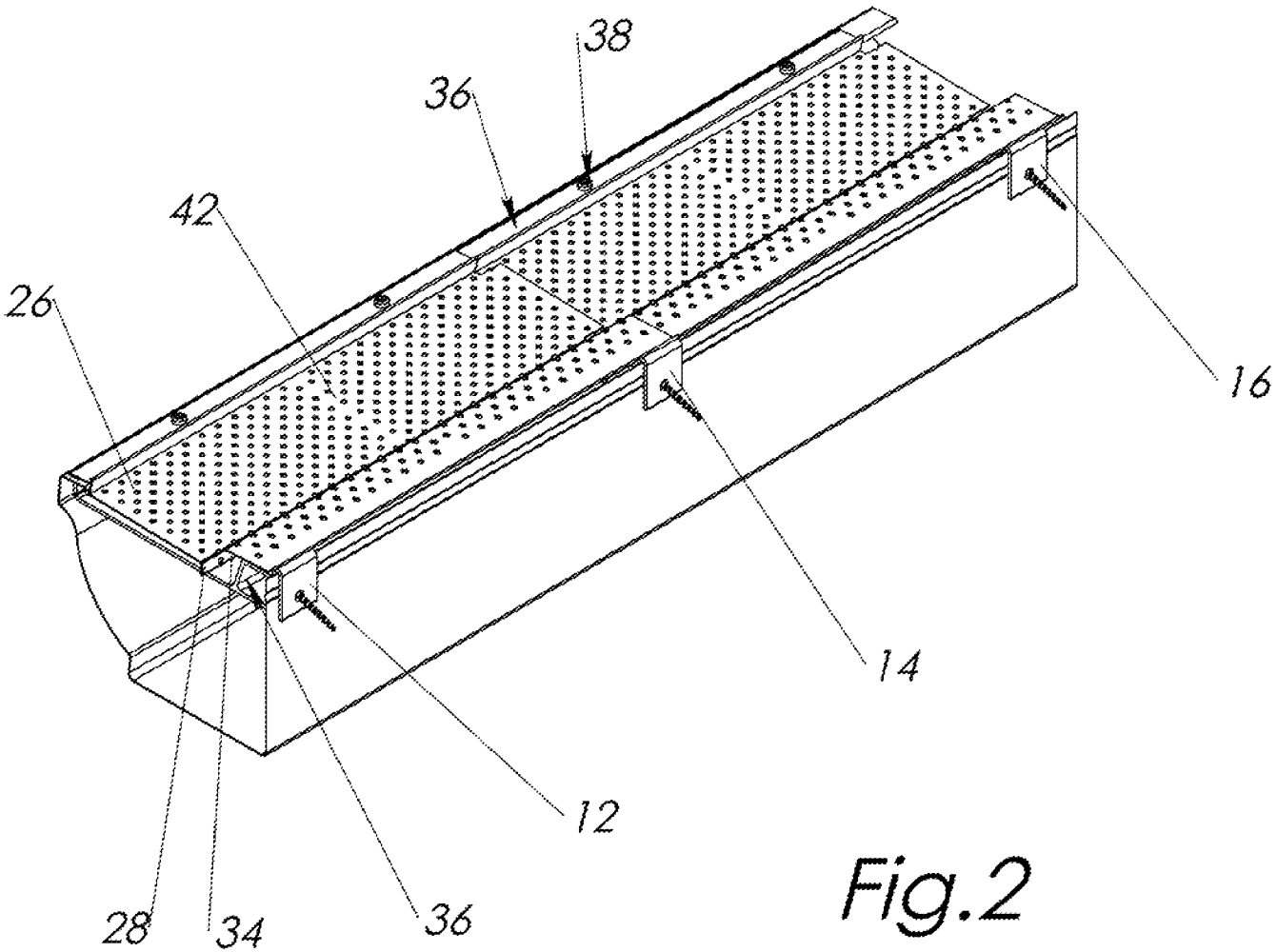
FIG. 2 is a perspective view of a gutter, a gutter hanger and a gutter guard according to the preferred embodiment, installed in the gutter.
Figure 3:
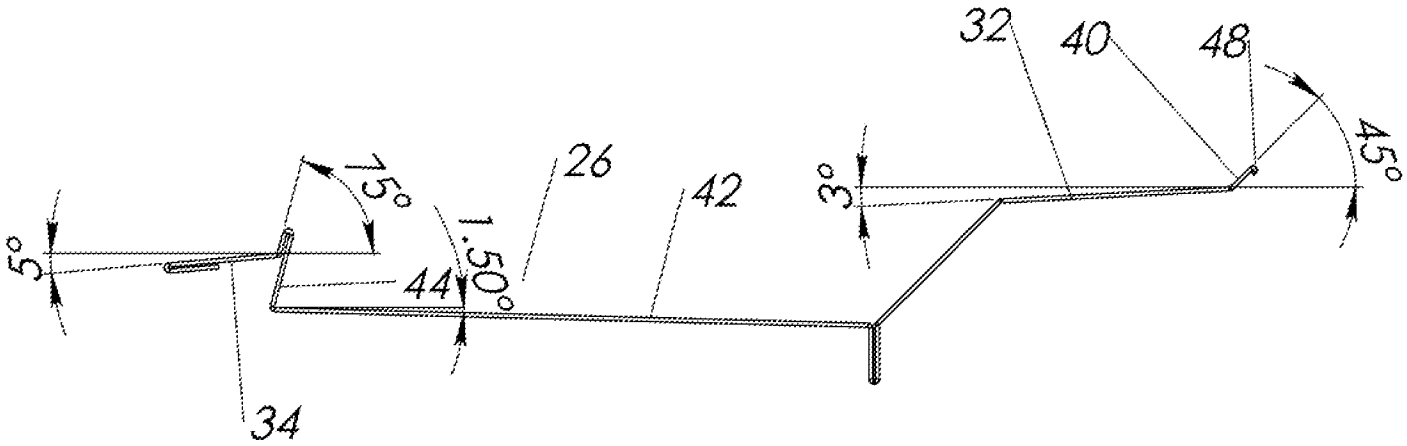
FIG. 3 is a side elevation of the gutter guard of the preferred embodiment.
Figure 4:
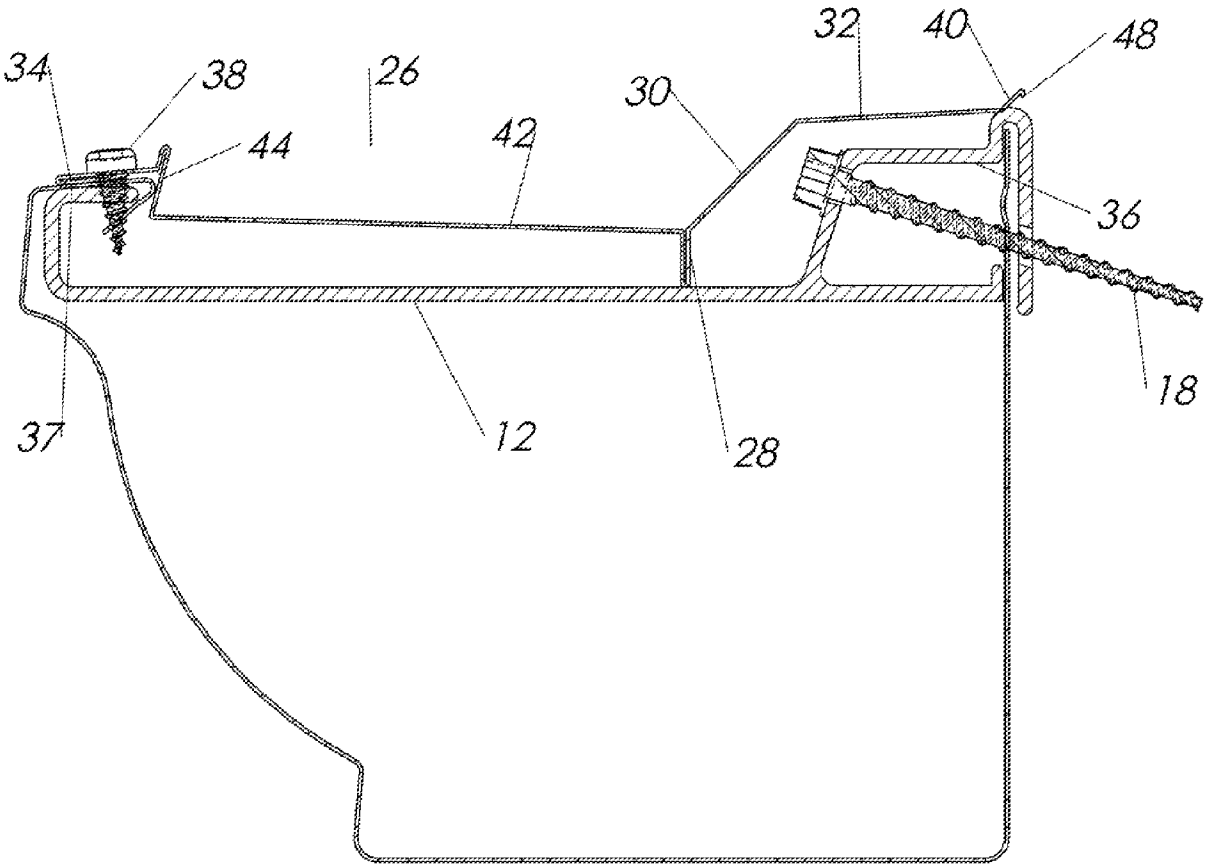
FIG. 4 is a cross-sectional view of a gutter, gutter hanger and a gutter guard according to the preferred embodiment installed in the gutter. For clarity, the apertures in the guard are not shown in this view; and, FIG. 5 is a plan view of the guard.

FIGS. 2 and 4 are views of a gutter 10 with gutter hangers 12, 14, 16, and a gutter guard 26 according to the preferred embodiment while FIG. 3 is a side elevation of the gutter guard 26 according to the preferred embodiment.

In this description, the portion of the guard and gutter that are adjacent the fascia of the building will be referred to as the "back" or "rear" and the portions distal from the fascia will be referred to as the "front" or "forward" portions.

Guard 26, which is formed as a single piece of extruded or roll-formed material, includes a downwardly extending leg 28 adapted to either rest directly on the gutter hangers 12, 14, 16 or to abut them when the guard is urged down into the gutter (for example by the installer, during cleaning or under the weight of snow or ice). Leg 28 also serves to provide longitudinal rigidity to the guard that facilitates handling of long segments of guard and facilitates a friction fit installation of the guard by pressing its rearmost end against the fascia of the building. The support leg 28 extends downward a distance substantially less than the depth of the gutter 10.

The rear of the guard 26 forms a shoulder 34 to provide clearance for the fastening shoulders 36 of the gutter hangers and their associated wall screws. Shoulder 34 is formed by a first upwardly inclined wall 30 and a second upwardly inclined top wall 32 extending rearward from the first inclined wall 30.

According to the preferred embodiment, leg 28 is formed at the juncture between the central planar surface 42 and the upwardly inclined wall 30.

The guard 26 is therefore adapted to be easily positioned in the gutter by resting leg 28 on the gutter hangers 12, 14, 16 so as to recess the guard within the gutter without interference from the hanger shoulders 36 while also avoiding the risk of inserting it too deep into the gutter 10 during installation. During installation, the rearmost end of the guard is disposed such that it is substantially proximal to a rear edge of the gutter 10.

The front end of the guard 26 is formed to provide a flat attachment flap 34 that provides a surface for securement to the underlying gutter lip 37, for example by means of a screw 38. At the rear of the guard, top wall 32 terminates in a segment 40 that is angled upward at about 45° to allow bending and resilient abutment for a friction fit to the fascia boards.

In the preferred embodiment, central planar portion 42 extends forwardly from leg 28. Central portion 42, diagonal wall 30 and top wall 32 are each provided with a regular pattern of apertures 46 to create a porous surface. Central portion 42 acts as the principal drainage surface of the guard 26. Preferably an upstanding wall 44 is provided between planar portion 42 and attachment flap 34 to contain water flowing from the roof and to prevent it from spilling over the forward lip 37 of the gutter.

Planar portion 42 has a slight (between 1° and 3°, preferably 1.5°) rearward incline to promote the rearward flow of water. Top wall 32 is inclined upward at an angle of between 1.5° and 4°, preferably 3°, from front to back. The slight incline of the top wall 32 is designed to keep water from migrating toward the fascia of the building.

The attachment flap 34 extends downwardly from back to front at an angle of between 3° and 7°, preferably about 5°, in order to direct water to the front of the gutter and to provide an approximately flush line when viewed from in front of the building.

In order to avoid the risk posed by sharp edges during handling, the attachment flap 34 is folded over at its end to provide a smooth forward edge. Similarly the tip 48 of rear edge 40 is preferably rounded for the same reason and to avoid scoring of the fascia.

Figure 5:
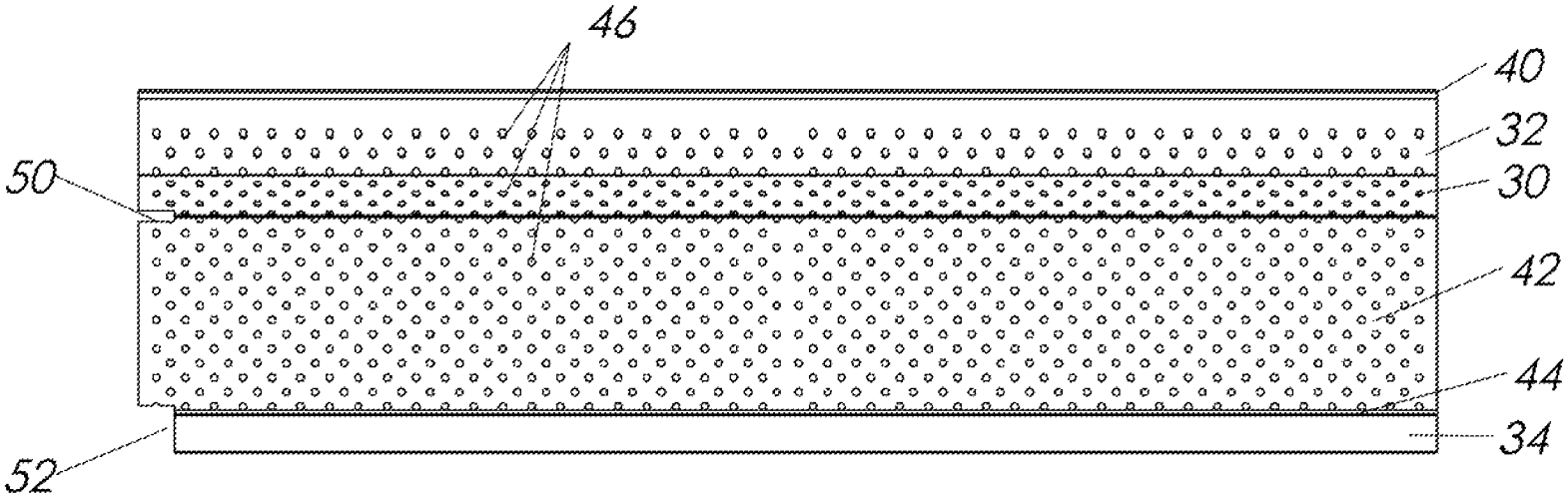

In installing gutter guards end to end along a gutter, gaps between the guards should be avoided. In the case of gutter guards that are flush stackable, this is achieved by simply overlapping the guards. However, the presence of leg 28 prevents the guards from overlapping in a flush relationship. In order to accommodate partial overlapping of the ends of the guards, the leg 28 is omitted from a short segment of at least one end of the guard and is replaced by a slot 50 of sufficient width to accommodate the leg of an adjacent guard, as illustrated in FIG. 5. This allows partial flush overlapping of the guards during installation in a gutter. Alternatively, the leg 28 can simply be omitted from a short segment and the gutter guard from which the leg 28 is omitted can be simply overlaid on the side adjacent guard.

Similarly, a portion of the upstanding wall 44 and the attachment flap 34 is omitted along a short segment 52 to allow overlapping of end to end adjacent guards.

It will be appreciated by those skilled in the art that the preferred and alternative embodiments have been described in some detail but that certain modifications may be practiced without departing from the principles of the invention, the scope of which is defined principally by the claims.

The invention claimed is:

1. A rain gutter guard made of a single piece of perforated sheet metal, bent into a shape from front to rear and adapted for use in a recessed position within a gutter, said gutter being mounted to a building wall by a series of spaced gutter hangers, each gutter hanger having a mounting shoulder proximal to said building wall, and an arm extending away from said shoulder in a direction away from said building wall, said gutter guard comprising:

a front, comprising a substantially flat attachment flap adapted to overlie a front lip of said gutter and wherein said sheet metal is folded underneath itself in a 180° turn, to form a front most edge that is a metal fold and therefore blunt;

a substantially planar porous central web portion extending rearward from said front;

a rear portion comprising a shoulder extending rearwardly and upwardly in relation to said central web portion, and shaped and positioned to rest on said mounting shoulders of said gutter hangers; and a leg extending downwardly from said central web portion, said leg adapted to rest on said arms of said gutter hangers, at a location displaced from said mounting shoulders of said gutter hangers, when said gutter guard is urged downward within said gutter.

2. The rain gutter guard according to claim 1 wherein said gutter guard is shaped so that when said shoulder rests on said mounting shoulders of said gutter hangers said central web portion is recessed within said gutter.

3. The rain gutter guard according to claim 1 wherein said shoulder comprises a first diagonal wall extending rearward from said central web portion and a second wall extending substantially rearward from said first diagonal wall.

4. The rain gutter guard according to claim 1 wherein a rearmost end of said gutter guard comprises an upwardly angled segment for resilient abutment against said building wall and wherein a rearmost segment of said rearmost end, is a downward fold in said sheet metal so that a rearmost edge of said gutter guard is blunt.

5. The rain gutter guard according to claim 1 further comprising an upstanding wall between said front and said central web portion.

6. The rain gutter guard according to claim 1 wherein said attachment flap is attached to said central web portion by a portion in which said sheet metal is bent upwardly, and then downwardly through a 180° turn and extends downwardly from said 180° turn until it undergoes a turn to a substantially horizontal rearward direction.

7. The rain gutter guard according to claim 1 wherein said central web portion has a rearward downward inclination.

8. The rain gutter guard according to claim 7 wherein said inclination is between 1° and 3°.

9. The rain gutter guard according to claim 3 wherein said second wall extends rearward and upward at a slight angle.

10. The rain gutter guard according to claim 9 wherein said angle is between 1.5° and 4°.

11. The rain gutter guard according to claim 1 wherein said attachment flap has a slight angle to the horizontal.

12. The rain gutter of claim 11 wherein said angle is between 3° and 7°.

13. The rain gutter guard according to claim 1 wherein a rearmost end of said gutter guard comprises a segment at an angle of approximately 45° for resilient frictional abutment against said building wall.

14. The rain gutter guard of claim 1 wherein a portion of said leg has been omitted for short distance from a side edge of said gutter guard to allow partial overlapping of adjacent gutter guards.

15. The rain gutter guard of claim 1, wherein said downwardly extending leg is formed by a series of bends in said web, in a path defined by said web extending from said wall, a first bend of said series causing said web to extend substantially downwardly along said path, a second bend causing said web to extend substantially upwardly along said path, and a third bend causing said web to extend substantially horizontally along said path, said web between said second and third bend abutting said web between said first and second bend.

* * * * *